United States Patent [19]

Sato

[11] Patent Number: 4,707,889

[45] Date of Patent: Nov. 24, 1987

[54] ATTACHING DEVICE FOR BAG

[76] Inventor: Hidejiro Sato, 8-1-102, Hanegi 1-Chome, Setagaya-Ku, Tokyo, Japan

[21] Appl. No.: 893,208

[22] Filed: Aug. 5, 1986

[30] Foreign Application Priority Data

Aug. 14, 1985 [JP] Japan ..... 60-124691[U]

[51] Int. Cl.[4] ..... B65D 77/00

[52] U.S. Cl. ..... 24/30.5 R; 24/559; 150/105; 150/124; 248/101; 248/316.7

[58] Field of Search ..... 24/30.5 R, 30.5 L, 487, 24/559; 383/34; 150/120, 124, 125, 105; 190/123; 248/101, 316.7

[56] References Cited

U.S. PATENT DOCUMENTS

| | | | |
|---|---|---|---|
| 3,621,539 | 11/1971 | Ayers | 24/30.5 R |
| 3,707,271 | 12/1972 | Sanchez et al. | 248/101 |
| 3,727,657 | 4/1973 | Landis | 150/124 X |
| 3,861,630 | 1/1975 | Ady | 248/101 X |
| 4,368,767 | 1/1983 | Friedman | 150/120 X |

FOREIGN PATENT DOCUMENTS

| | | | |
|---|---|---|---|
| 1037014 | 9/1953 | France | 150/120 |
| 1125137 | 8/1956 | France | 150/120 |

*Primary Examiner*—Kenneth J. Dorner

*Assistant Examiner*—James R. Brittain, Jr.

*Attorney, Agent, or Firm*—Fred Philpitt

[57] ABSTRACT

The attaching device for bag in which a pair of mouthpieces made of synthetic resin material is provided, and said pair of mouthpieces is provided with an engaging member formed by providing a stationary portion and a slope portion of a predetermined angle in the upper part of the stationary portion integrally by extending and projecting thereof and connecting a pawl portion integrally and foldably by means of a thin connecting portion, and a base plate formed by integrally projecting an edge portion formed with a groove portion on the lower part of the front surface of a long plate of a predetermined length, and said stationary portion is fixed to a reverse surface of the base plate and the tip of the pawl portion is engaged on the groove of the base plate, and when the stationary portion of the mouthpiece is urged against the other mouthpiece from the outside, the mutual slope portions extend and the pawl portion is separated from the groove portion of the base plate, and openable levers that are resiliently openable are connected to an end of each mouthpiece, and an opening edge of the bag is engaged on the groove portion of the base plate at each pawl portion of said pair of mouthpieces.

2 Claims, 7 Drawing Figures

ATTACHING DEVICE FOR BAG

BACKGROUND OF THE INVENTION

This invention relates to an attaching device for bag, and more particualrly to an attaching device provided with a pair of mouthpieces made of synthetic resin material, and said pair of mouthpieces is provided with an engaging member formed by providing a stationary portion and a slope portion of a predetermined angle in the upper part of the stationary portion integrally by extending and projecting thereof and connecting a pawl portion integrally and foldably by means of a thin connecting portion, and a base plate formed by integrally projecting an edge portion formed with a groove portion in the lower part of the front surafce of a long plate of a predetermined length, and said stationary portion is fixed to a reverse surface of the base plate and the tip of the pawl portion is engaged on the groove of the base plate, and when the stationary portion of the mouthpiece is urged against the other mouthpiece from the outside, the mutual slope portions extend and the pawl portion is separated from the groove portion of the base plate, and openable levers that are resiliently openable are connected to an end of each mouthpiece and an opening edge of the bag is engaged on the groove portion of the base plate at each pawl portion of said pair of mouthpieces, and an opening edge of the bag such as vinyl bag or paper bag is attached to the attaching device exchangeably, and attachment and removal of the bag to and from the attaching device is easy and simple.

Heretofore, mouthpieces of various structures have been proposed which hold bags such as a vinyl bag or paper bag at its opening edge in such a way that the bags can be replaced. As one of the mouthpieces, a mouthpiece made of elongate plate is proposed in which one mouthpiece portion is formed as a stationary side and the other mouthpiece portion is formed as a mobile side that performs an opening/closing operation by means of folding portions, but the conventional mouthpiece of this kind has a drawback that when the mouthpiece is opened, the weight of an article accommodated in the bag is in tilt to the mouthpiece portion that becomes the opening/closing side causing torsion on the folding portion which tends to become broken due to cracks and the like, and also, in the condition where the mouthpiece is open, the engagement of the bag at the mouthpiece portion at the mobile side receiving the weight of the bag tends to be released or disengaged and moreover in general, mounting or removing work of the bag is an extremely troublesome work which is the drawback.

SUMMARY OF THE INVENTION

An object of this invention is that a pair of mouthpieces is formed in a construction of opening and closing by V-shaped levers, and even when the mouthpieces are in open condition, the weight of an article accommodated in the bag is applied uniformly on each of said pair of mouthpieces, and the engagement of the bag to the mouthpieces is arranged to be firm and solid, and as a result, no part of the mouthpieces is broken due to the weight of the article.

Another object of this invention is that attachment of the bag or removal of the bag from the pair of the mouthpieces can be easily and simply carried out by providing each pawl member on the pair of mouthpieces and engaging and disengaging an opening edge of the bag on the pawl members.

A still another object of this invention is that in the condition where the pair of mouthpieces is closed, and in case one mouthpiece is urged against the other mouthpiece, top portion points of mutual slope portions push with each other to extend the slope portions and the pawl portions are lifted upward accompanied by the extension of the slope portions causing the pawl members released from the groove portions automatically, and with mere pressing of the bag engaged with the pair of mouthpieces on the other mouthpiece from the one mouthpiece, the bag engaged on the mouthpieces can be released by touch of a finger.

DETAILED DESCRIPTION OF THE INVENTION

Figure 1:
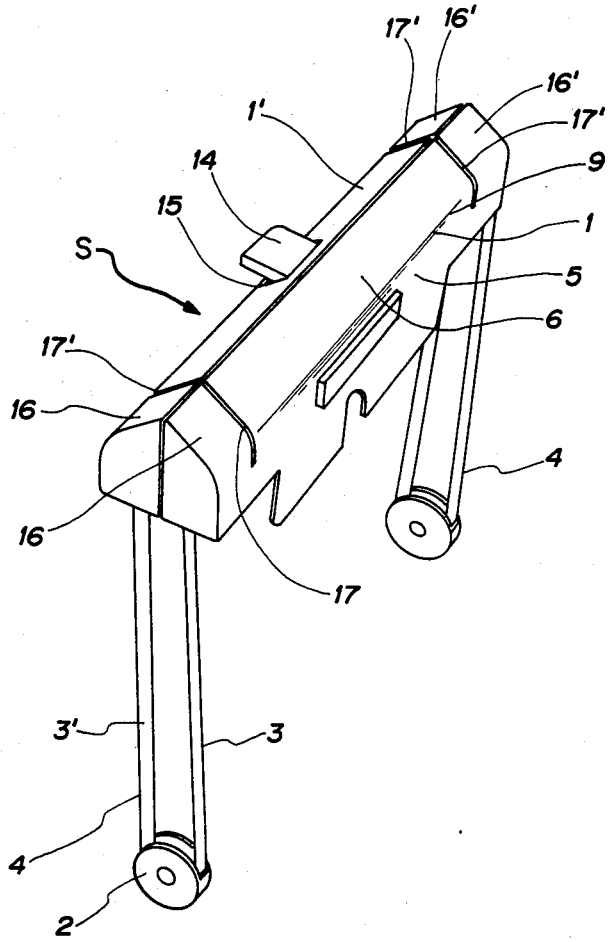
FIG. 1 is a perspective view showing a pair of mouthpieces in closed condition.
Figure 2:
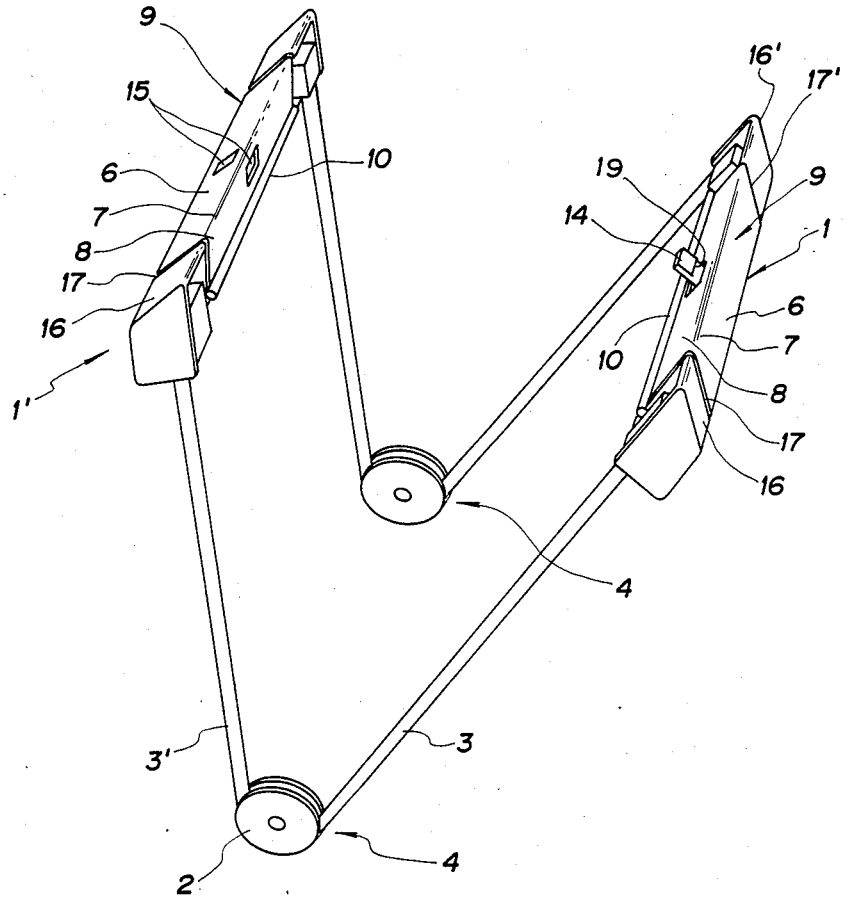
FIG. 2 is a perspective view showing a pair of mouthpieces in open condition.
Figure 3:
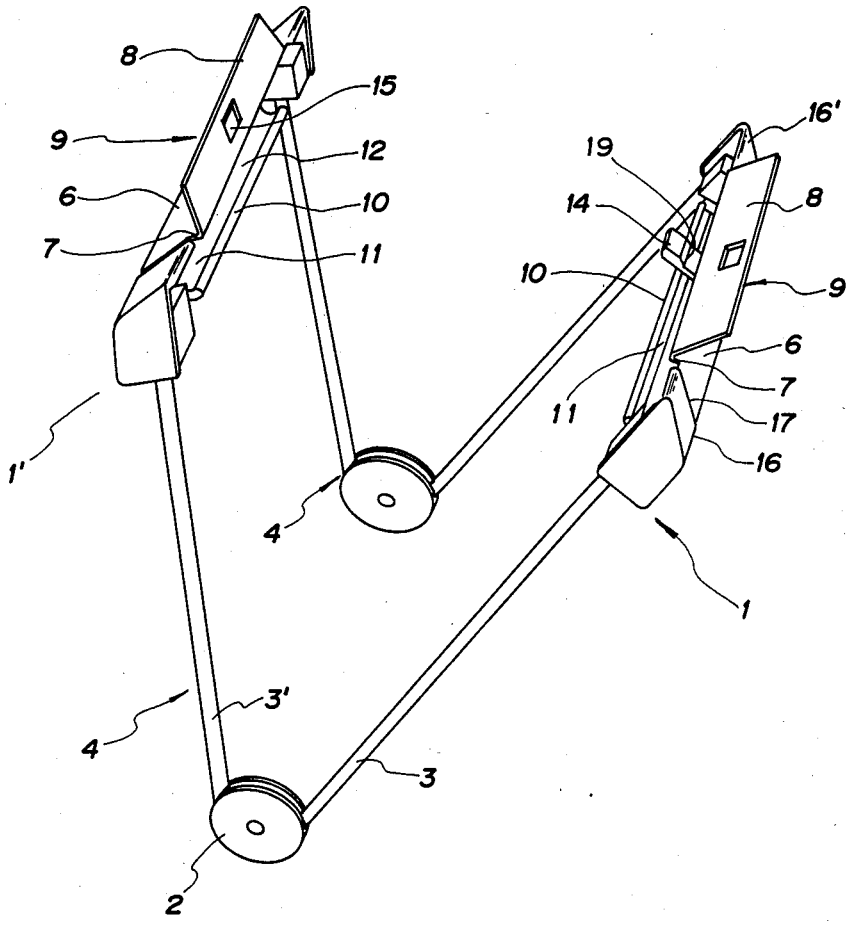
FIG. 3 is a perspective view showing a pair of mouthpieces with pawl portions being released.
Figure 4:
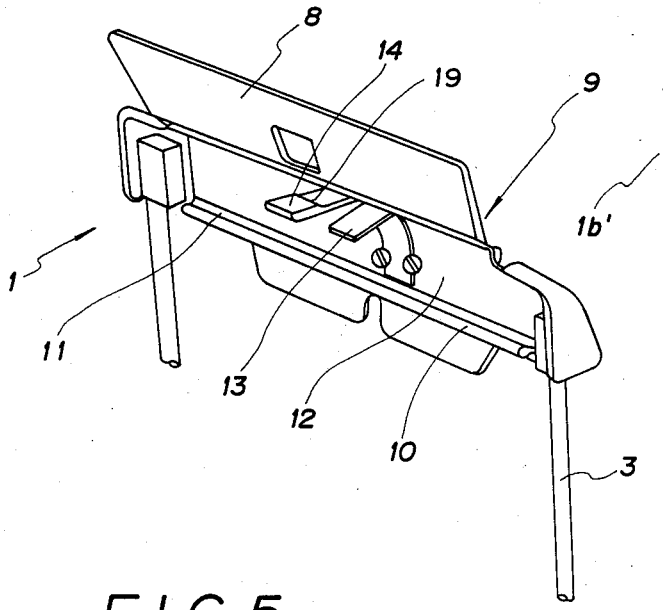
FIG. 4 is a perspective view of an essential portion showing an inside of mouthpiece by opening the pawl portion upward.

The device proper represented by an ordinary letter S is constructed in such a way that a pair of mouthpieces 1, 1' is provided, and said pair of mouthpieces 1, 1' is openably formed by providing openable levers 4, 4 that can open and close resiliently by two pieces of bars 3, 3' projected in V-shape by means of pivot portion 2 at both mutual ends, and said pair of mouthpieces 1, 1' is made of synthetic resin material, and an engaging member is provided which has a stationary portion 5, and a slope portion 6 rising and sloping at a predetermined angle is integrally extended and projected in the upper part of the stationary portion 5, and a pawl portion 8 is connected integrally with an upper side of the slope portion 6 by means of a connecting portion 7 of thin piece so as to be bendable or foldable, and a base plate 12 is provided which is made of an elongate plate of a predetermined length and an edge portion 10 being integrally projected on front surface of its lower portion and a groove portion 11 is formed along an upper surface of this edge portion 10, and the stationary portion 5 of the engaging member 9 is fixed to the reverse surface of the base plate 12 to engage the tip of the pawl portion 8 with the groove portion 11, and said pair of mouthpieces 1, 1' is formed so that the mutual pawl portions 8 of the respective engaging members 9 are arranged to face with each other to superpose top edges of the slope portions 6 and to be openable resiliently by being provided at both ends of said pair of mouthpieces 1, 1' at the upper ends of the bars 3, 3' of the openable levers 4.

A plate spring 13 is fixed to the base plate 12 of the mouthpieces 1, 1' and the pawl portion is made to be resilient by this plate spring 13. Also, a stud 14 is projected outwardly in the center portion of the pawl portion 8 of the one mouthpiece 1, and a through hole 15 running through the slope portion 6 is formed in the center portion of the pawl portion 8 of the other mouthpiece 1' to close the pair of the mouthpieces 1, 1' by resisting the resilient force of the openable lever 4.

Cover portions 16, 16' are provided at both ends of the mouthpieces 1, 1', and the cover portions 16, 16' are formed integrally with the engaging members 9 in extended form, and upper end of each bar 3, 3' of the openable lever is fixed to the inside of each cover portion 16, 16'. However, in order not to block the resilient characteristics of the pawl portion 8, it is preferable to form notches 17, 17' separating the engaging member 9 from the cover portions 16, 16' deep enough to the stationary portion 5.

The mouthpiece 1 having the stud 14 is provided with a sucking disc 18 at an extended lower end portion of the stationary portion 5 forming the engaging member 9.

The openable lever is formed in such a way that a range of opening/closing is set at a predetermined range by matching with an opening of a bag 20 to be attached to a pair of the mouthpieces 1, 1', and the bag 20 is not released from the mouthpieces 1, 1' due to an excessive opening of the pair of the mouthpieces 1, 1'.

Accordingly, when the opening edge of the bag 20 is engaged with the groove portion 11 provided on the edge portion 10 of the base plate 12 by the tip of the pawl portion 8 of the pair of the mouthpieces 1, 1' whereby the bag 20 can be firmly and solidly attached to the pair of the mouthpieces 1, 1'. The opening of the mouthpieces 1, 1', namely, the opening of the bag 20 is performed by the stud 14. For example, when the mouthpieces 1, 1' are superposed, the stud 14 is inserted into the through hole 15 of the other engaging member 9 to be engaged with the upper edge of the through hole 15 by the engaging step portion 19 of the stud 14 to keep the pair of the mouthpieces 1, 1' closed. Also, in case of opening the pair of the mouthpieces 1, 1', the pair of the mouthpieces 1, 1' can be opened simply by the resilient force of the openable lever 4 by pressing down the stud 14 downwardly. Since the pair of the mouthpieces 1, 1' is constructed to open and close by a V-shaped lever 4, even if the mouthpieces 1, 1' are open, the weight of the article accommodated in the bag 20 is uniformly applied to each of the pair of the mouthpieces 1, 1', and thus, the engagement of the bag is made positive and solid, and there is no part subject to receiving undue load which may result in the breaking of the pair of the mouthpieces 1, 1'. Furthermore, since the openable lever 4 is controlled of the range of opening/closing of the bars 3, 3' with the pivot portion 2 at a predetermined range by matching the opening of the bag 20, undue pulling force is not exerted on the opening of the bag 20 attached to the pair of the mouthpieces 1, 1' even when the mouthpieces 1, 1' are open so that the opening of the bag 20 is not broken and is positively and solidly engaged on the pair of the mouthpieces 1, 1'.

Next, in case of removing the bag 20 attached to the mouthpieces 1, 1', when the mouthpiece 1 is urged against the other mouthpiece 1' in the condition where the pair of the mouthpieces 1, 1' is closed, the slope portions 6 are caused to extend by the pressing of top points of the slope portions 6, and the pawl portion 8 is floated upward which is accompanied by the extension of the slope portion 6, and the tip of the pawl portion 8 is floated from the groove portion 11 and at the same time, the pawl portion 8 is burst open outwardly by the plate spring 13 thereby to release the pawl portion 8 from the groove portion 11, and the bag 20 engaged on the pair of the mouthpieces 1, 1' is separated automatically from the engaging member 9. Therefore, the bag 20 engaged on the mouthpieces 1, 1' can be released by a touch of finger by merely pressing the mouthpiece 1 against the other mouthpiece 1'.

Figure 5:
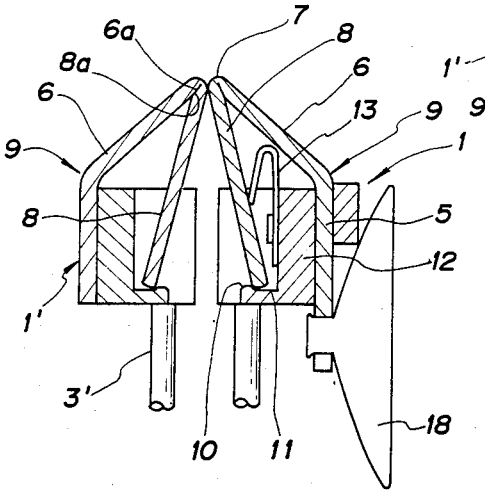
FIG. 5 is a perspective view of a pair of mouthpieces in closed condition.
Figure 7:
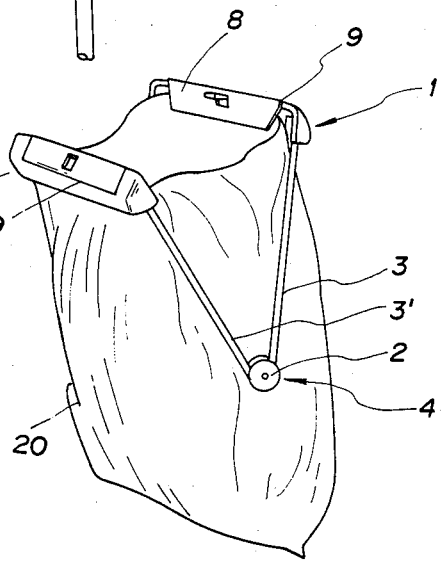
FIG. 7 is a perspective view showing a pair of mouthpieces being open with the bag being attached.

The engaging member 9 is formed in such a way that the slope portion 6 of a predetermined angle is extended integrally on the upper part of the stationary portion 5 and the pawl portion 8 is integrally connected to be foldable by means of a thin connecting portion 7, and the connecting portion 7 of the slope portion 6 and the pawl portion 8 is formed as shown in FIG. 5 that the pawl portion 8 and the inside top points 6*a* and 8*a* of the slope portion 6 and the pawl portion are engaged, is folded to engage the groove portion 11 of the base plate 12, and when the pair of the mouthpieces 1, 1' in the closed condition is operated, namely, the mouthpiece 1 is urged against the other mouthpiece 1', the pawl portion 8 is caused to be urged against the slope portion 6 immediately.

Figure 6:
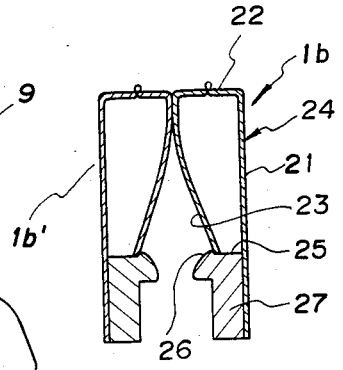
FIG. 6 is a perspective view of a mouthpiece of another embodiment according to this invention.

FIG. 6 shows another embodiment of this invention, in which a pair of the mouthpieces 1*b*, 1*b*' is formed in such a way that a horizontal portion 22 folding in right angles upward of respective stationary portion 21 is extended and projected integrally, and an engaging member 9 is provided which is formed by integrally extending and projecting a horizontal portion 22 bent in right angles upward of respective stationary portion 21 and folding a pawl portion 23 formed with a slope of a predetermined angle to the inside at the tip of the horizontal portion 22 which is integrally extended and projected, and a base plate 27 is provided which is formed by integrally projecting an edge portion 26 having a groove portion 25 on the lower part of the front surface of a long plate of a predetermined length, and the stationary portion 21 of the engaging member 24 is fixed to the reverse surface of the base plate 27, and the tip of the pawl portion 23 is engaged on the groove portion 25 of the base plate 27, and the mouthpiece 1*b* is caused to urge against the other mouthpiece 1*b*' to cause the engagement of the horizontal portion 22 and the horizontal portion 22 and the stationary portion 21 are bent backward to separate the pawl portion 23 from the groove portion 25 provided on the base plate 27.

Therefore, this invention is to provide an attaching device for bag which facilitates an attachment and removal of the bag easily and simply by attaching the bag such as vinyl bag or paper bag and the like on an opening edge of the attaching device exchangeable, and a pair of mouthpieces is arranged to open and close by a V-shaped lever. In case the mouthpieces are open, the weight of an article accommodated in the bag is applied uniformly to a pair of the mouthpieces, and thus, the engagement of the bag on the attaching device is positive and solid, and even if the weight is exerted, there is no location at which undue load of breaking the pair of the mouthpieces is applied. Furthermore, since the openable lever is formed to control a range of opening/closing of bars in a predetermined range by the pivot portion, undue force is not applied to the opening of the bag attached to the attaching device when the pair of the mouthpieces is open so that there is no chance of breaking the opening of the bag, and the bag can be engaged on the pair of the mouthpieces positively. Moreover, the bag attached to the mouthpieces can be removed by a touch of a finger by merely pressing the one mouthpiece against the other mouthpiece, and the use is extremely simple and easy which is an advantageous point of the attaching device of this invention.

What is claimed is:

1. A device for gripping and holding the open end of a bag in a manner to alternately close the top of the bag and to then open up access to the interior of the bag, said device comprising two juxtaposed mouthpieces (1, 1') and pivot support means (2, 3, 4) to permit movement of said mouthpieces alternately toward and away from each other, the improvement comprising that each of said mouthpieces includes:

(a) an elongated base plate (12) that extends in a generally horizontal direction, (1) the inner edge portions (10) of the base plates (12) of said mouthpieces each containing an elongated groove (11), (b) stationary portions (5) extending upwardly from the outer portions of said elongated base plate (12), (c) sloping portions (6) extending inwardly and upwardly from said stationary portions (5), (d) pawl portions (8) connected along the uppermost edges of said sloping portions (6) by a thin connecting portion (7) that permit said pawl portions (8) to be folded or pivoted through a limited arc, the outer unconnected edge portion of said pawl portion constituting an engaging member (9) and being foldable downwardly to engage with said elongated groove (11) of said elongated base plate (12) and to clamp therebetween at least a portion of the open end of a bag, and (e) cooperative engagement means (14, 15) on said mouthpieces which will permit said mouth pieces (1, 1') to be alternately locked together in an abutting relationship or spread apart.

2. A device according to claim 1 which includes spring means (13) that exerts an outward force against said pawl portion (8).

* * * * *